US005318059A

United States Patent [19]

Lyons

[11] Patent Number: 5,318,059

[45] Date of Patent: Jun. 7, 1994

[54] METHODS AND APPARATUS FOR PREVENTION OF WATER PIPE FREEZE-UP IN A DWELLING

[76] Inventor: Kevin D. Lyons, P.O. Box 415, Alachua, Fla. 32615

[21] Appl. No.: 935,904

[22] Filed: Aug. 27, 1992

[51] Int. Cl.[5] ..... E03B 7/12

[52] U.S. Cl. ..... 137/62; 137/340; 137/59; 137/79

[58] Field of Search ..... 137/340, 79, 59, 62, 137/60; 126/347, 435

[56] References Cited

U.S. PATENT DOCUMENTS 4,632,180 12/1986 Lauderdale ..... 126/435
4,657,038 4/1987 Lyons .
5,115,491 5/1992 Perlman ..... 137/340

*Primary Examiner*—Martin P. Schwadron
*Attorney, Agent, or Firm*—Burns, Doane, Swecker & Mathis

[57] ABSTRACT

The freezing of water pipes in a dwelling in cold climates is prevented by separating some of the cold water delivered to the dwelling and conducting that separated cold water into heat exchanging relationship with a hot water tank. The thus-warmed water is caused to flow through a cold water main of the dwelling whenever an outlet is automatically periodically opened by means of a temperature sensing valve unit connected to the outlet. The water flowing through the cold water main warms the water in branch lines and at the outlet to prevent that water from freezing.

22 Claims, 2 Drawing Sheets

METHODS AND APPARATUS FOR PREVENTION OF WATER PIPE FREEZE-UP IN A DWELLING

BACKGROUND OF THE INVENTION

The present invention relates to the prevention of water pipe freeze-up in a dwelling.

During cold weather conditions, it is possible for one or more water pipes in a dwelling to freeze and then burst, whereby expensive repairs to the pipes and the dwelling itself may be required.

In moderate climates where the minimum outside temperature only rarely extends below freezing, dwellings might not be provided with an indoor valve for shutting-off the supply of water to an outdoor faucet. In such a case, the risk of freezing can be avoided by placing on the outdoor faucet an automatically actuable valve unit which senses the temperature of water at the faucet and opens to emit a water flow whenever the temperature approaches the freezing point. In this way, warmer ground water from within the dwelling will reach the faucet, whereupon the temperature sensor will cause the valve unit to close. Accordingly, the valve unit will open and close periodically during periods of cold weather, in order to prevent the water from freezing at the faucet. A temperature sensitive valve unit of this type is disclosed for example in the inventor's U.S. Pat. No. 4,657,038 issued Apr. 14, 1987, and can be purchased from KDL Technologies, P.O. Box 1375, Alachua, Fla. 32615 under the name FREEZE/-GUARD TM.

While the use of such a temperature sensitive valve unit successfully functions to prevent pipe freeze-up in moderate climates, it may not be as successful in colder climates. That is, in colder climates (e.g., where the ground water temperature can be expected to fall below 42° F.), the water temperature within certain pipes within the dwelling may fall below freezing despite the use of a temperature sensitive valve unit. While this can happen in the case of dwellings which are occupied, it is especially problematic in the case of homes which are unoccupied during the winter. In the latter case, it is necessary to drain the water pipes which is a time-consuming and often difficult procedure.

It is, therefore, an object of the invention to prevent water pipe freeze-up in any climate, even in the case of unoccupied dwellings in cold climates.

SUMMARY OF THE INVENTION

The present invention involves methods and apparatus wherein cold water is conducted from a cold water supply line through a heat exchange line in which the water is warmed by water that has been heated by a hot water tank. The exchange of heat may take place inside or outside of the hot water tank. The thus-warmed water is conducted to a cold water main line within the dwelling. A water outlet communicating with the cold water main line and is automatically periodically opened by a valve mechanism connected to the outlet, so that the water warmed in the heat exchange line periodically flows through the cold water main line.

In the case where there are branch lines branching from the cold water main line upstream of the outlet, the water in those branch lines will be warmed by the warmed water flowing through the cold water main line.

The cold water main line can also receive cold water directly from the cold water supply line, which cold water is mixed with the warmed water from the heat exchange line. The ratio of water flowing to the cold water main line from the heat exchange line on the one hand, and directly from the cold water supply line on the other hand can be varied by suitable valving.

The outlet to which the valve mechanism is connected can be located outside or inside of the dwelling.

BRIEF DESCRIPTION OF THE DRAWING

The objects and advantages of the invention will become apparent from the following detailed description of preferred embodiments thereof in connection with the accompanying drawings in which like numerals designate like elements and in which.

DETAILED DESCRIPTION OF PREFERRED EMBODIMENTS OF THE INVENTION

Figure 1:
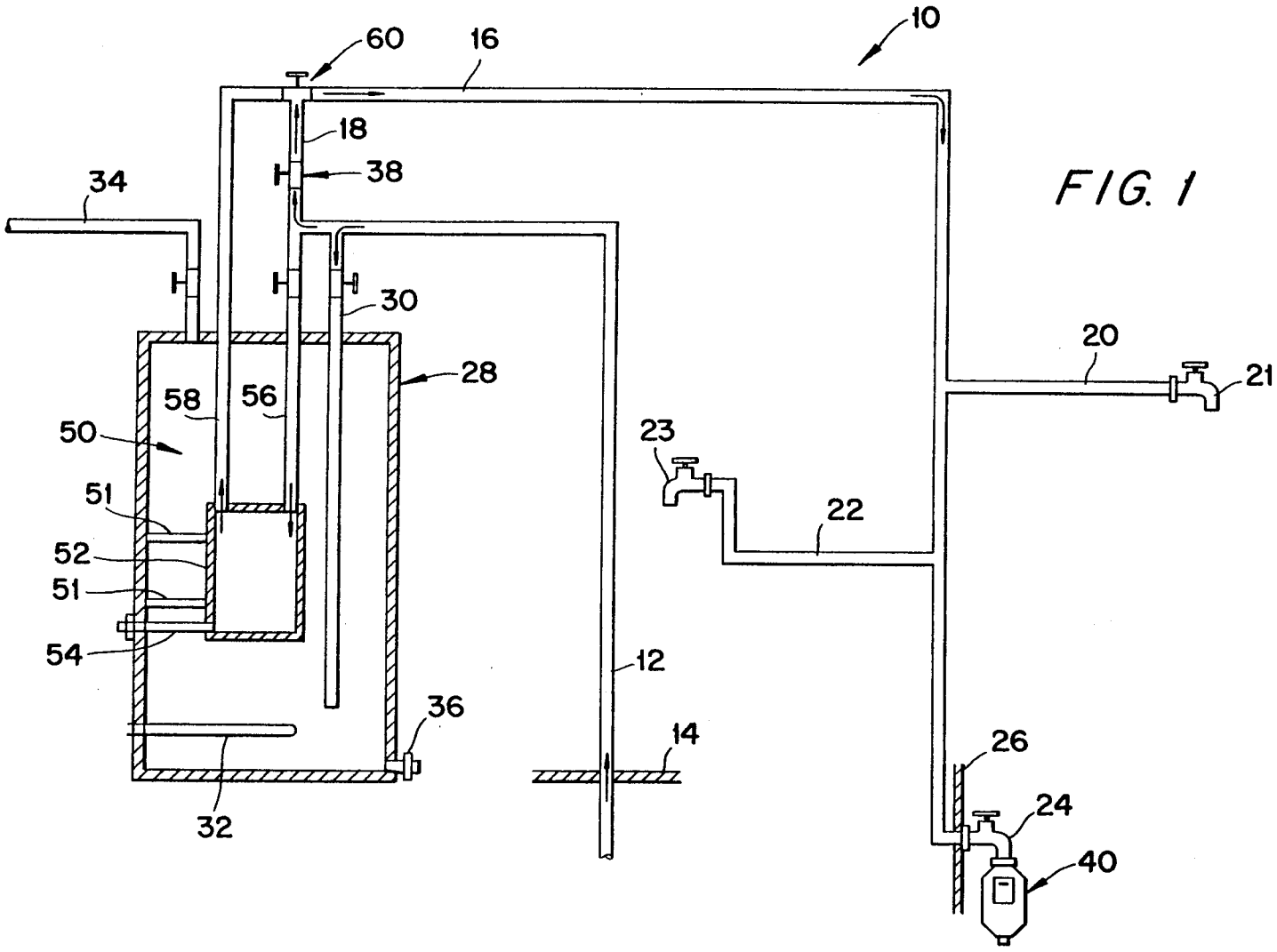
FIG. 1 is a schematic view of a portion of a water pipe system for a dwelling according to a first embodiment of the invention.

Depicted schematically in FIG. 1 is a portion of a water pipe system 10 for a dwelling such a residence, office, etc. A cold water supply line 12 passes through a wall or floor 14 of the dwelling for supplying cold water, e.g., from a well or municipal facility. That cold water is fed to a cold water main line 16 via a secondary line 18. The cold water main line 16 feeds the cold water to cold water branch lines 20, 22 located within the dwelling (e.g., for sinks, toilets, tubs, etc.). The branch lines can be closed by faucets 21, 23. An outdoor faucet 24 provided at a wall 26 of the dwelling (e.g., an exterior wall) receives water from the cold water main line 16.

Water is also fed from the cold water supply line 12 to a hot water tank 28 via a secondary line 30. The hot water tank 28 is connected to a source of energy, such as electricity which is connected to a conventional resistance heater 32. Alternatively, the hot water tank 28 could be connected to other sources of energy, such as solar or natural gas for example. Water heated in the hot water tank is supplied to various hot water branch lines (not shown) in the dwelling via a hot water main line 34. The hot water tank 28 has a conventional drain 36 at its lower end.

As noted earlier, even in moderate climates the outside temperature may occasionally be expected to fall below freezing, whereby water at the outside faucet might freeze, thereby presenting the risk of a pipe burst which can produce damage to the pipe and dwelling. The risk of pipe freeze-up can be minimized by shutting off the line 16 at a location near the outdoor faucet 24. However, in many moderate climates the risk of outdoor faucet freezing is so rare that the dwellings are not provided with a shut-off valve for that purpose. That is, it would be necessary to shut-off the entire cold water main line 16, e.g., by a valve 38.

That problem can be avoided by attaching to the faucet 24 a valve unit 40 which is capable of sensing water or pipe temperature at the faucet 24 and automatically periodically opening the pipe when temperature below a certain temperature (near freezing) is sensed. This permits water of higher temperature (i.e., ground water) to flow to the faucet from inside the dwelling and eliminate the immediate risk of pipe freeze-up. One suitable unit is described in the inventor's afore-mentioned U.S. Pat. No. 4,657,038, the disclosure of which is incorporated by reference herein.

While such a valve unit 40 is ideally suited to certain climates, e.g., where the temperature of ground water received from the cold water supply line is not expected to fall below about 42° F., the unit is less suited to colder climates, e.g., in which the ground water temperature is expected to fall below 42° F. That is, in the colder climates, the ground water located within the dwelling that is supplied to the outdoor faucet 24 during the valve-open condition of the unit 40 may not be warm enough to avoid pipe freeze-up for an appreciable period, i.e., the unit 40 may have to remain in a valve-open position for extended periods. Also, the ground water may not be warm enough to transfer sufficient heat to the water in some or all of the branch lines 20, 22 when the branch line faucets 21, 23 are closed.

The risk of pipe freeze-up in colder climates is especially evident in the case of unoccupied homes in which the main heating system is shut down for the winter. In such a case it is necessary to drain the water pipes, which is time-consuming and often difficult.

In accordance with the present invention, however, that problem is eliminated by the provision of a heat exchange line 50 which ensures that the water conducted through the cold water line 16 during a valve-open condition of the unit 40 is sufficiently warm to prevent branch line freeze-up, and which minimizes the possibility that the unit 40 will remain in a valve-open condition for excessive periods.

The heat exchange line 50 includes a water container 52 which is mounted by struts 51 within the hot water tank 28 by any suitable support structure 54. A drain pipe 53 enables the container 52 to be drained from outside of the hot water tank. The container communicates with the cold water supply line by a secondary line 56. Water present within the contain 52 is thus disposed in heat-exchanging relationship with the hot water in the hot water tank 28 and becomes warmer than the water in the cold water supply line 12.

The container 52 communicates with the cold water main line 16 by a secondary line 58 where it can be combined with cold water received directly from the cold water supply line via secondary line 18. The ratio of water flows received from the secondary lines 18 and 58 can be adjusted by a suitable valve, such as a conventional mixing valve 60 as shown, or by separate valves disposed in the lines 18 and 58.

By varying that ratio, the temperature of water in the cold water main line 16 can be correspondingly varied. For instance, it may be desired to increase the proportion of warmed water from line 58 during the evening hours in an occupied dwelling or permanently in an unoccupied dwelling.

In any event, a suitable ratio can be selected to ensure that, in cooperation with the valve unit 40, the water temperature in the branch lines 20, 22 and at outdoor faucet 24 will remain above freezing.

It is not necessary that the unit 40 be mounted on an outdoor faucet. Rather, the unit could be mounted on an indoor faucet, such as for example on a faucet of a laundry room sink, or elsewhere, where water discharged from the unit can be drained off. In such a case, both the hot and cold faucets could be left open, thereby providing anti-freeze-up protection for the hot water lines as well as for the cold water lines. Of course, the unit should be located so that, when the unit is in a valve-open state, the water warmed in the heat exchange line will travel past any branch lines which are at risk of freezing.

In the case of a home being left unoccupied for the winter, it will, of course be necessary to keep the hot water tank turned on throughout the winter, in addition to supplying energy to the unit 40. The latter could be powered by electricity from the dwelling, or by a battery optionally having a solar recharging capability. Also, in the case of a home left unoccupied, it may be desired to adjust the mixing valve 60 so that all of the water from the co d water supply line 12 passes through the heat exchange line.

Figure 2:
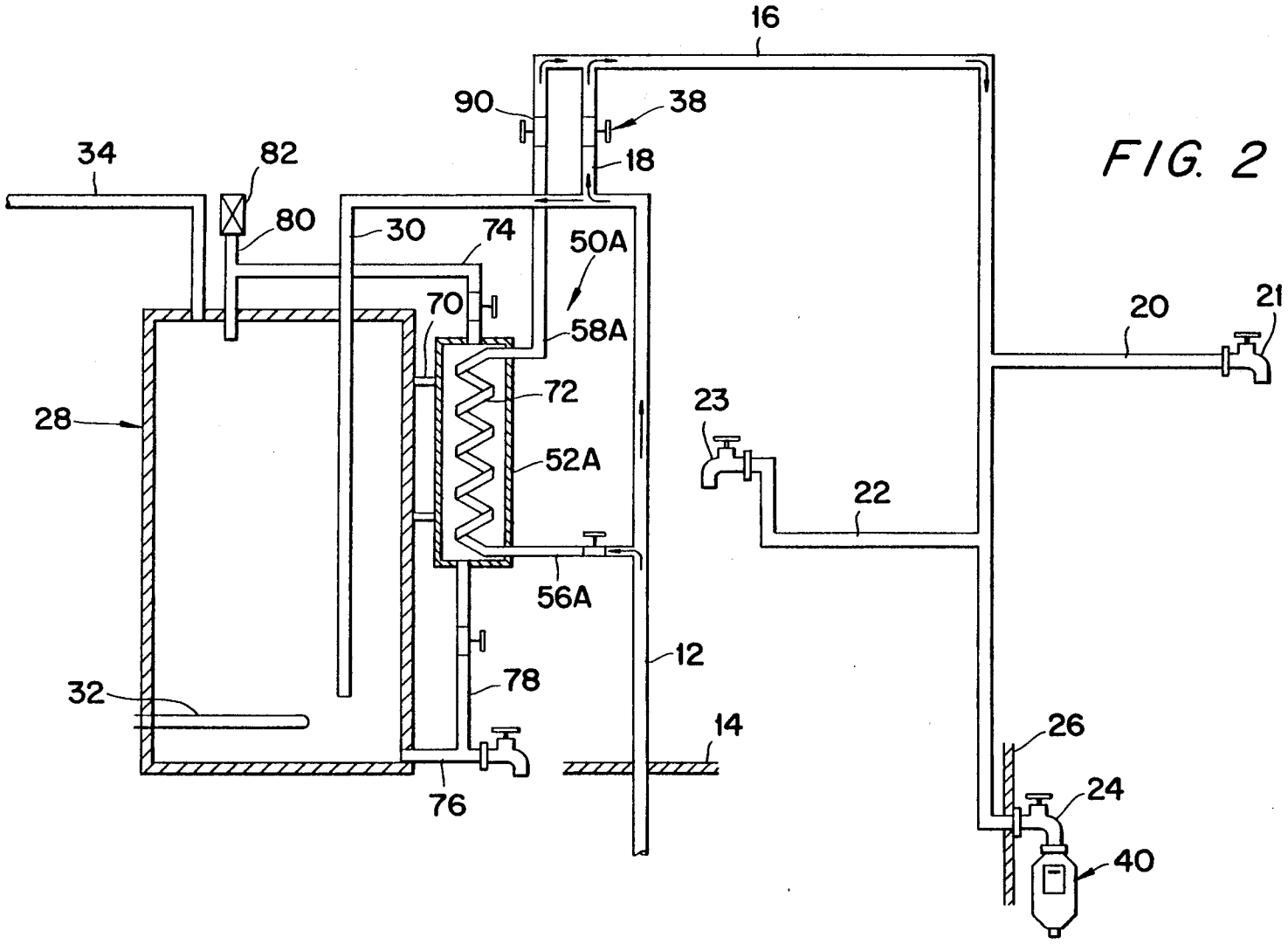
FIG. 2 is a view similar to FIG. 1 of a second embodiment of the invention.

An alternative arrangement of the heat exchange line is depicted in FIG. 2. In that arrangement, the heat exchange line 50A comprises a water container 52A which is suitably mounted outside of the hot water tank 28, e.g., by supports 70. The container 52A can be mounted on the side of the tank 28 as shown, or on the top thereof. Disposed within the container 52A is a heat exchange coil 72, one end of which communicates with the cold water supply line 12 via a secondary line 56A. The other end of the coil communicates with the cold water main line 16 via a secondary line 58A.

An upper end of the container 52A communicates with an upper end of the hot water tank 28 by a secondary line 74, and a lower end of the container 52A communicates with a lower end (e.g., the drain 76) of the hot water tank 28 via a secondary line 78. The secondary line 74 is connected to a line 80 which carries a conventional flow valve 82 for the hot water tank 28. As a result, the container 52A will be occupied by water which, although not as hot as the water in the tank 28, will be warmed by the water in the tank 28 by means of a thermally induced circulation through the secondary lies 74, 78.

Hence, cold water from the cold water supply line 12 which passes through the coil 72 will be warmed. That warmed water will then be mixed in the cold water main line 16 with cold water from the secondary line 18. The ratio of those two mixed water flows can be varied by means of valves 38 and 90 positioned in the lines 18 and 58A, respectively. Alternatively, a mixing valve 60 (as shown in FIG. 1) could be employed for that purpose.

The operation of the system shown in FIG. 2 is similar to that described earlier in connection with FIG. 1, the main difference being that the exchange of heat between the cold water located in the heat exchange line and the hot water heated in the tank 28 takes place outside of the tank 28, rather than inside of the tank.

Since the container 52A is located outside (and not inside) of the hot water tank, the volume (capacity) of the tank is not reduced. Also, because the container 52A is connected to existing ports of a hot water heater (i.e., the port for the blow valve 80, and the bottom drain port, little modification of the hot water tank is needed.

The present invention thus provides a simple, economic way of preventing pipe freeze-up not only in moderate climates, but also in the very coldest climates. Moreover, in the case of a home being left unoccupied over the winter, it is unnecessary to drain the pipes.

It will be appreciated that in connection with FIG. 1, it would be possible to replace the container 52 with a coil (similar to coil 72 of FIG. 2) disposed in the hot water tank for a more efficient heat exchange procedure.

Although the present invention has been described in connection with preferred embodiments thereof, it will be appreciated by those skilled in the art that addition, deletions, modifications, and substitutions not specifically described may be made without departing from the spirit and scope of the invention as defined in the appended claims.

What is claimed is:

1. A water pipe freeze prevention apparatus for a dwelling having a cold water supply line for supplying cold water into the dwelling, a cold water main line disposed in the dwelling and hydraulically connected to receive water from said cold water supply line, a water outlet hydraulically connected with said cold water main line, and a hot water tank, connected to a source of energy for heating water supplied by said cold water supply line, said water pipe freeze prevention apparatus comprising:

a heat exchange line for conducting water from said cold water supply line to said cold water main line and being arranged so as to exchange heat with water heated by said hot water tank such that cold water from said cold water supply line is warmed by water from said heat exchange line, and outlet opening means for automatically periodically opening said water outlet, whereby warmed water from said heat exchange line periodically flows through said cold water main line.

2. A water pipe freeze prevention apparatus according to claim 1, wherein said heat exchange line passes through said hot water tank.

3. A water pipe freeze prevention apparatus according to claim 2, wherein said heat exchange line includes a water container disposed inside of said hot water tank.

4. A water pipe freeze prevention apparatus according to claim 1, wherein said heat exchange line is situated outside of said hot water tank and communicates with said water tank.

5. A water pipe freeze prevention apparatus according to claim 4, wherein said heat exchange line comprises a water container mounted outside of said hot water tank and connected to said hot water tank to receive water therefrom, and a heat exchange conduit disposed in said water container and having one end communicating with said cold water supply line and another end communicating with said cold water main line.

6. A water pipe freeze prevention apparatus according to claim 5, wherein said water container is connected to said hot water tank at upper and lower ends of said water container, said lower end being connected to a drain located at a lower end of said hot water tank.

7. A water pipe freeze prevention apparatus according to claim 6, wherein said upper end is connected to a conduit having a lower end communicating with the interior of said hot water tank, and also having another end carrying a blow valve.

8. A water pipe freeze prevention apparatus according to claim 5, wherein said conduit is coil-shaped.

9. A water pipe freeze prevention apparatus according to claim 1 including at least one branch line connected to said cold water main line upstream of said outlet, whereby water in said branch line is warmed by warmed water flowing through said cold water main line from said heat exchange line.

10. A water pipe freeze prevention apparatus according to claim i including a secondary line connected to said cold water main line separately from said heat exchange line for conducting cold water directly thereto, and valve means for adjusting the ratio of water which said cold water main line receives from said secondary line and said heat exchange line.

11. A water pipe freeze prevention apparatus according to claim 1, wherein said outlet is located at an exterior wall of the dwelling.

12. A water pipe freeze prevention apparatus according to claim 1, wherein said outlet is located within the dwelling.

13. A water pipe freeze prevention apparatus according to claim 1, wherein said outlet opening means comprises a temperature sensing unit which opens said outlet upon sensing a temperature below a predetermined value.

14. A method of preventing cold water pipe freeze-up within a dwelling having a cold water supply line delivering cold water into said dwelling, a cold water main line disposed in said dwelling and hydraulically connected to receive water from said cold water supply line, a water outlet hydraulically connected with said cold water main line, and a hot water tank connected to a source of energy for heating water supplied by said cold water supply line, said method comprising the steps of:

conducting cold water from said cold water supply line so as to exchange heat with water heated by said hot water tank to warm the water in said heat exchange line, and automatically periodically opening said water outlet to permit water to flow therethrough, whereby warmed water from said heat exchange line periodically flows through said cold water main line.

15. A method according to claim 14, wherein said conducting step comprises conducting cold water so as to exchange heat with water disposed in said hot water tank.

16. A method according to claim 14, wherein said conducting step comprises conducting cold water into and from a water container disposed in said hot water tank.

17. A method according to claim 14, wherein said conducting step comprises conducting cold water outside of said hot water tank in heat exchanging relationship with said hot water tank.

18. A method according to claim 17, wherein said conducting step comprises connecting cold water to and from a heat exchange conduit disposed within a container that is disposed outside of said hot water tank, and communicating hot water from said hot water tank to said container and into heat exchanging relationship with said heat exchange conduit.

19. A method according to claim 14 including at least one branch line connected to said cold water main line upstream of said outlet, whereby water in said branch line is warmed when warmed water from said heat exchange line flows through said cold water main line.

20. A method according to claim 14, wherein some cold water from said cold water supply line is conducted to said cold water main line separately from water conducted from said heat exchange line and is mixed therewith at an adjustable ratio.

21. A method according to claim 14, wherein water passes through said outlet outside of said dwelling.

22. A method according to claim 14, wherein water passes through said outlet within said dwelling.

* * * * *